United States Patent [19]

Kountz et al.

[11] 4,355,948

[45] Oct. 26, 1982

[54] ADJUSTABLE SURGE AND CAPACITY CONTROL SYSTEM

[75] Inventors: Kenneth J. Kountz, Hoffman Estates, Ill.; Dean K. Norbeck, York, Pa.

[73] Assignee: Borg-Warner Corporation, Chicago, Ill.

[21] Appl. No.: 235,266

[22] Filed: Feb. 17, 1981

Related U.S. Application Data

[62] Division of Ser. No. 75,042, Sep. 12, 1979, Pat. No. 4,275,987.

[51] Int. Cl.[3] ..... F01D 17/02

[52] U.S. Cl. ..... 415/1; 415/17

[58] Field of Search ..... 415/1, 14, 15, 17, 36

[56] References Cited

U.S. PATENT DOCUMENTS

| | | | |
|---|---|---|---|
| 1,761,797 | 6/1930 | Pfau | 415/1 X |
| 3,030,070 | 4/1962 | Krauss | 415/1 |
| 3,063,460 | 11/1962 | Krauss | 415/1 X |
| 3,339,568 | 9/1967 | Kerensky | 415/1 X |
| 3,355,906 | 12/1967 | Newton | 62/228 R |
| 3,555,844 | 1/1971 | Fleckenstein et al. | 62/228 D |
| 3,695,774 | 10/1972 | Martz et al. | 415/17 |
| 3,780,532 | 12/1973 | Norbeck | 62/201 |
| 4,151,725 | 5/1979 | Kountz et al. | 62/288 C |
| 4,275,987 | 6/1981 | Kountz et al. | 415/17 |

*Primary Examiner*—Everette A. Powell, Jr.
*Attorney, Agent, or Firm*—Thomas B. Hunter

[57] ABSTRACT

An adjustable surge and capacity control system for matching a capacity control system to an inverter-driven centrifugal compressor based liquid chiller having unknown surge characteristics. The necessary adaptation of the capacity control circuit to a particular chiller is attained by the provision of two potentiometers which are adjustable to develop a functional which avoids surge and operates the system in an efficient manner at all feasible operating point loads and heads. The use of a circuit employing a pair of potentiometers permits the formation of the appropriate functional with two degrees of shaping flexibility.

2 Claims, 4 Drawing Figures

COMPRESSOR SPEED DEPENDENCE ON PRV POSITION, FOR FIXED COMPRESSOR HEAD
RPM. CHANGE IN SPEED FROM MIN. MACH NO. FOR WIDE OPEN VANES
CHANGE IN MACH NUMBER
2000
1500
1000
500
0
0.5
0.4
0.3
0.2
0.1
0
0 1/8 1/4 1/2 3/4 WOV
PRV OPENING
1
2
ACTUAL FUNCTION
SURGE LINE
SURGE REGION

TEST Pt C 25.35DM
10V
9
8
7
6
5
4
3
2
1
0
0 1 2 3 4 5 6 7 8 9 10 VOLTS
CLOSED 1/8 1/4 1/2 3/4 WOV
PRV POSITION
MAX. ALLOWED PRC OPENING
DURING TEST

ADJUSTABLE SURGE AND CAPACITY CONTROL SYSTEM

This is a division of application Ser. No. 075,042 filed Sept. 12, 1979, now U.S. Pat. No. 4,275,987 dated June 30, 1981.

BACKGROUND OF THE INVENTION

A. Field of the Invention

This invention relates in general to inverter driven centrifugal liquid chillers and more specifically, to the control system for controlling the capacity of an inverter driven centrifugal compressor.

More specifically, without restriction to the particular use which is shown and described, this invention relates to an adjustable surge and capacity control circuit for an inverter driven centrifugal compressor based liquid chiller whereby the control circuit of the invention permits a capacity control system to be matched to existing equipment having unknown surge characteristics.

In the operation of liquid chillers employing inverter driven centrifugal compressors, it is advantageous for efficient and economical operation to regulate the capacity of the system by adjusting both the position of inlet guide vanes (PRV) and the compressor motor speed. In such chillers it is desirable that the motor speed and PRV position adjustments be made over an extended range without compressor surge occurring. Surge becomes a significant problem when the pre-rotation vanes (PRV) are in a condition nearly closed whereby small changes in vane position has a very substantial effect on the compressor capacity and can send the compressor into detrimental surging.

One capacity control system, which is highly effective in controlling capacity through adjustment of PRV position and compressor motor speed, while avoiding surging, is disclosed in U.S. Pat. No. 4,151,725 to Kountz et al and assigned to the assignee of the present invention. In the control system disclosed in U.S. Pat. No. 4,151,725, circuitry is provided which develops the set point compressor speed as a function of pre-rotation vane (PRV) position. By regulating the speed of the compressor and the extent of opening of PRV in a manner to follow the mathematical function developed for a system having known characteristics, a control system, which avoids surge and achieves highly efficient operation, is disclosed in the subject patent to Kountz et al.

Although the circuit described in U.S. Pat. No. 4,151,725 is capable of attaining efficient operation of a chiller, the control system therein is not readily adaptable to control an inverter driven centrifugal liquid chiller having unknown surge characteristics. Thus, a factory set functional, which is described in the Kountz patent, does not provide on-site flexibility in input/output relationship. Without such adaptability, it is possible that a centrifugal chiller having undetermined surge characteristics would surge or perform inefficiently at some operating points.

B. Description of the Prior Art

One control system for centrifugal liquid chilling machines utilizing adjustable circuitry components is shown in U.S. Patent No. 3,780,532 to Norbeck et al and assigned to the assignee of the present invention. The control system of Norbeck et al is directed to the elimination of "droop" associated with proportional position control.

SUMMARY OF THE INVENTION

It is, therefore, an object of this invention to increase the efficiency of a centrifugal liquid chiller while avoiding surging.

Another object of the invention is to tune a capacity control system to a particular liquid chiller having unknown compressor surge line characteristics.

A further object of this invention is to match a capacity control to a particular chiller system through the employment of an improved circuit.

Still another object of this invention is to tune a capacity control system to a chiller system for operation in an efficient manner without surge at all feasiable point loads and heads.

These and other objects are attained in accordance with the present invention wherein there is provided an adjustable surge and capacity control circuit for inverter-driven centrifugal compressor base liquid chillers whereby the circuitry of a control system can be adjusted to permit efficient operation in conjunction with a variety of centrifugal chillers having unknown surging characteristics. The adjustable circuit components of the circuit of the invention possess two degrees of functional shaping flexibility to insure that the system efficiently operates surge-free at all feasible operating point loads and heads.

DESCRIPTION OF THE DRAWINGS

Further objects of the invention, together with additional features contributing thereto and advantages accruing therefrom, will be apparent from the following description of a preferred embodiment of the invention which is shown in the accompanying drawings with like reference numerals indicating corresponding parts throughout, wherein.

DETAILED DESCRIPTION OF A PREFERRED EMBODIMENT

Figures 1, 4:
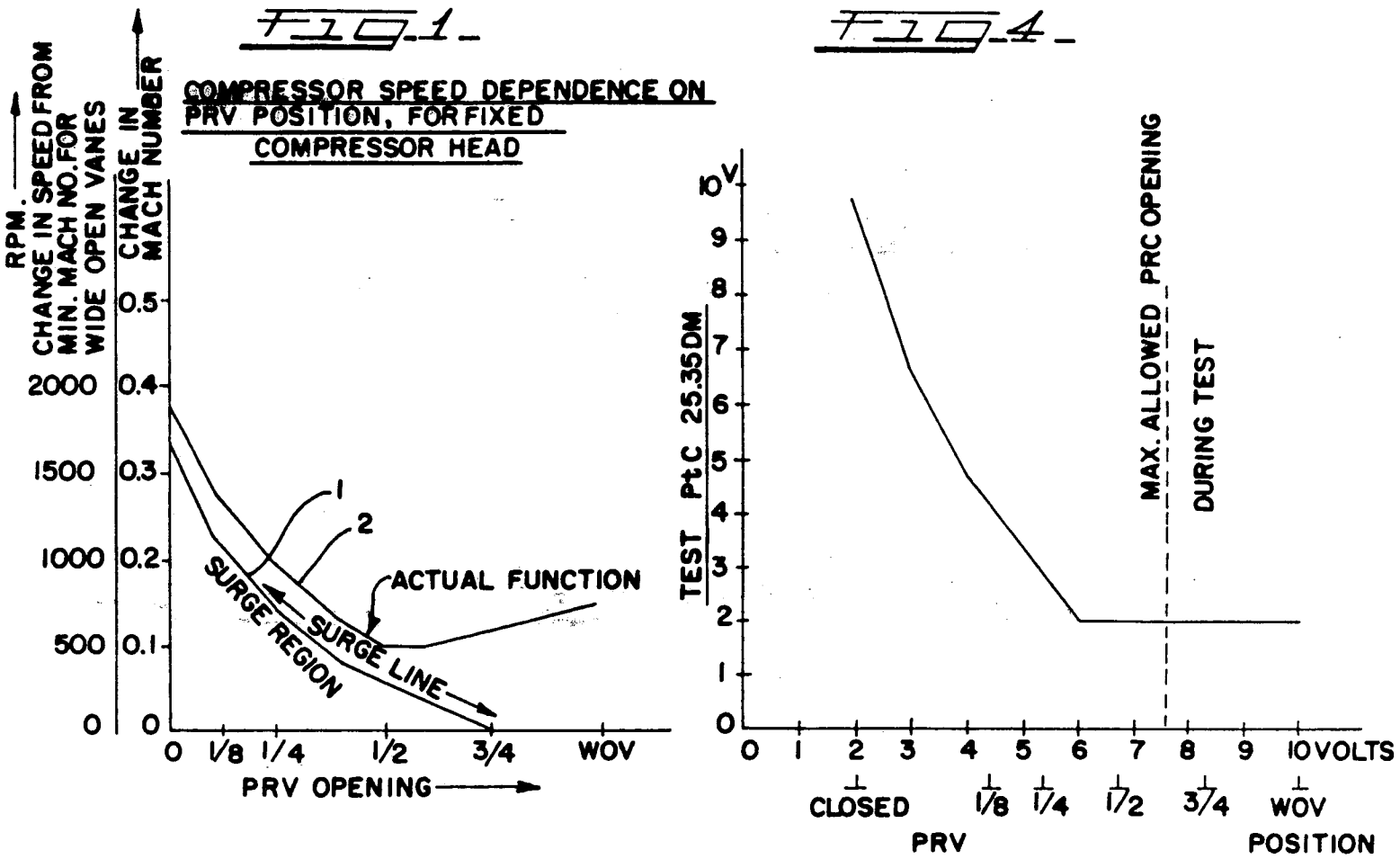
FIG. 1 is a graph of compressor speed dependent on PRV position, for a fixed head value.
FIG. 4 is a graphical illustration useful in understanding the operation of the invention.

FIG. 1 illustrates a pair of curves depicting the variation of compressor speed as a function of the opening of the PRV for a fixed compressor head value in an inverter-driven centrifugal compressor based liquid chillers as disclosed in U.S. Pat. No. 4,151,725, to which patent reference is specifically made herein. The curve 1 depicts a surge curve line developed from actual data based on surge characteristics of a given centrifugal water chiller, so that operation in the lower left portion of the curve would cause compressor surge. To avoid encountering surge, an actual functional 2 was derived, representing a mathematical function to regulate operation of the control system disclosed in U.S. Pat. No. 4,151,725. By regulating the speed of the compressor motor and the extent of opening of the PRV of the system of U.S. Pat. No. 4,151,725 to follow the functional 2, not only is surge avoided, but the system is operated substantially in the most energy efficient manner. That the control system can regulate operation along curve 2 is due in part to the effective derivation in the control system disclosed in U.S. Pat. No. 4,151,725 of the minimum Mach number Mo developed from the condensing and evaporating temperatures. Thereafter, the minimum Mach number, or head indicating system, is passed to the output side network of the circuit network. The signal derived from the PRV position potentiometer as shown in U.S. Pat. No. 4,151,725 is modified by suitable circuitry to produce a modified or functional signal for combination with the minimum Mach number signal. The combination of signals produces a signal which is then combined in the patented device to produce a "speed boost set point" signal for the inverter speed control portion of the control system. The term "speed boost" refers to the speed correction desired from the induction motor driving the compressor, considering the minimum Mach number Mo, the functional signal at the output side of the circuitry, and the actual motor speed signal as described in said patent to Kountz, et al. The resultant speed boost signal provides an efficient corrective value for regulating the induction motor speed in an optimum manner. The system functional 2 employed in U.S. Pat. No. 4,151,725 was derived from a particular centrifugal cooling system having surging characteristics which were known. However, the particular function as shown in FIG. 1 does not necessarily exist with respect to other types of centrifugal compressor chilling systems in which the surging characteristics are not known prior to being incorporated in existing chillers or chillers of different design and manufacturers.

Figure 2:
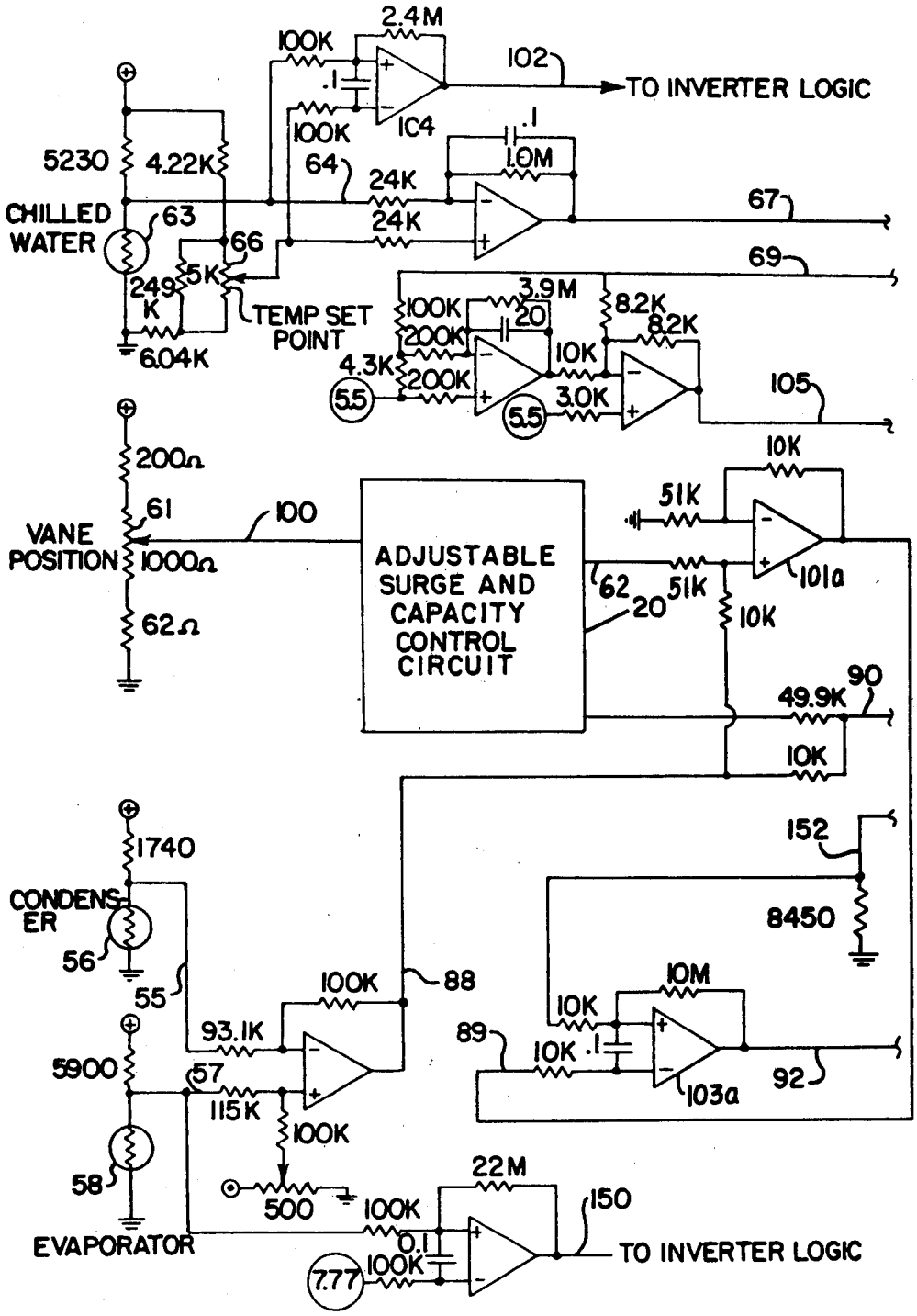
FIG. 2 is a schematic diagram illustrating a portion of the circuit details of a control system for controlling the capacity of a centrifugal compressor incorporating the adjustable surge and capacity control circuit of the invention shown in block diagram.

Referring to FIG. 2, there is illustrated a portion of the capacity control circuit described in U.S. Pat. No. 4,151,725 incorporating the adjustable surge and capacity control circuit of the invention to match the capacity control circuit to a given chiller system having unknown surging characteristics. The adjustable surge and capacity control circuit herein disclosed permits the functional 2 to be shaped to insure that the system does not surge at some operating points. The circuit diagram of FIG. 2 is derived from the circuit diagram of FIG. 6A of U.S. Pat. No. 4,151,725, which taken together with FIG. 6B and 6C thereof, illustrates the circuit details of the capacity control system in which the adjustable surge and capacity control circuit of the invention, generally designated by reference numeral 20, is incorporated replacing certain components. Thermistor 63 and its associated circuit elements to detect the chilled water outlet temperature need not be further described for an understanding of the present invention and reference is made to U.S. Pat. No. 4,151,725 for greater details relating to the chilled water temperature sensor of the capacity control circuit.

In FIG. 2, the refrigerant condensing temperature of the chiller is sensed by thermistor 56 and provides a signal on line 55, while the refrigerant evaporating temperature is sensed by thermistor 58 and provides another signal on line 57. These two signals are combined in differential amplifier 59 to provide on lines 88 and 89 a signal related to the minimum Mach number Mo for wide open vanes (PRV). The resulting signal is related only to the compressor head, and does not include any factor relating to vane position.

Figure 3:
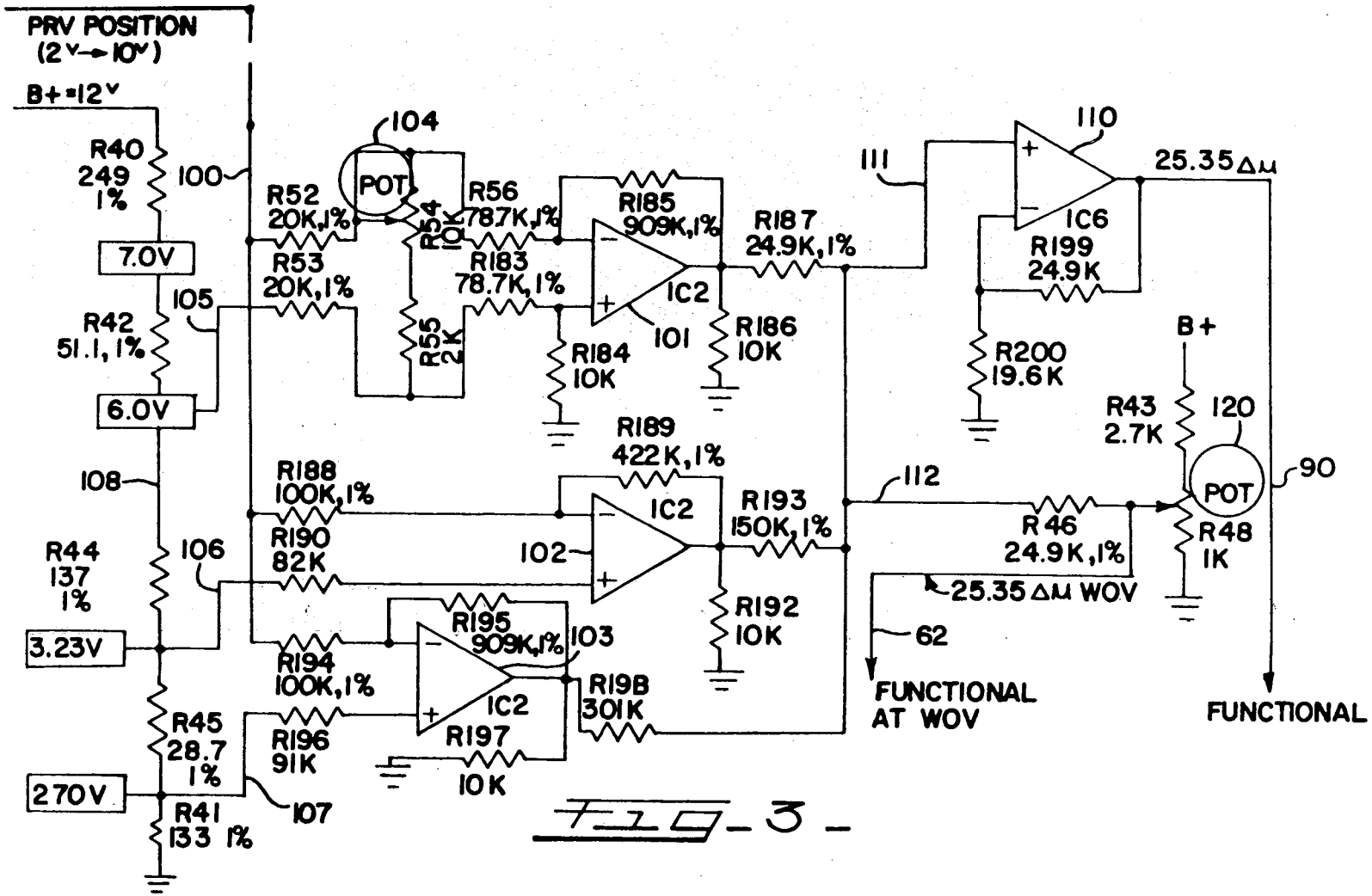
FIG. 3 is a schematic diagram which illustrates the circuit details of the adjustable surge and capacity control circuit of FIG. 2.

The vane position signal of the PRV is taken from potentiometer 61 (FIG. 2) and, over line 100, is supplied to the negative input connections of amplifier stages 101, 102 and 103 as shown in FIG. 3. Potentiometer 61 is shown in FIG. 2 with its movable arm or wiper mechanically coupled to the PRV, or to the output of the motor which drives the PRV. Thus, the electric signal on line 100 indicates the physical position (fully open, ¾ open, and so forth) of the inlet vanes in a continuous manner. The signal indicating PRV position is passed to the negative input of amplifier 101 through a pair of resistors and an adjustable potentiometer 104 which permits a variable degree of linear voltage to be added to the functional in the PRV voltage range, 2 volts to 6 volts. The wiper of the potentiometer 61 is at zero resistance (top) position in the wide open vane condition. The signal supplied to the inputs of amplifiers 102 and 103 over line 100 is also applied to the negative input thereof through selected resistors as shown in FIG. 3. Voltages representing the values shown in the drawing created by a 12 volt d-c source through selected resistors are passed over line 105 to the positive input of amplifier stage 101, over line 106 to the positive input of amplifier 102 and over line 107 to the positive input of amplifier 103.

The output of amplifier states 101, 102 and 103 are combined and applied to the positive input of an amplifier stage 110 over line 111. The output of amlifier 110, derived from the differential outputs of amplifiers 101, 102 and 103, represents a signal indicating the speed of deviation from the minimum Mach number based on the actual vane position. This signal is passed over line 90 and is combined with the output from line 88 as shown in FIG. 2 which represents a signal related to the minimum Mach number Mo for wide open vanes. Line 90 thus receives a positive input signal which is a composite function of both the speed change signal and the minimum Mach number Mo which may be applied to the logic circuit of the capacity control system such as shown, for example, in U.S. Pat. No. 4,151,725.

A potentiometer 120 which acts to translate selectively the function up or down when adapting the capacity control circuit to a particular chiller having unknown surge characteristics. The signal from potentiometer 120 is directed over line 62 to a logic circuit as shown in U.S. Pat. No. 4,151,725. The signal on line 62 as derived from potentiometer 120 in the control circuit 20 is a boost signal added via amplifier 101*a* to combine with the minimum Mach number for wide open vanes Molwov from line 88 to provide a new switching signal on line 89 for controlling amplifier 103*a*.

Referring now to FIG. 4, there is illustrated a graphical representation of an example of the formation of a suitable functional in accordance with the invention of the application. In the graph, PRV opening was in an expected range of 2 to 7 volts during tests of a given system representing 25.35 Δ M, the output on line 90, as function of vane opening.

The adjustable circuit 20 may be adjusted to form such a functional as illustrated in FIG. 4 by any desired technique, capable of adapting a capacity control circuit to the characteristics of the chiller to which the capacity control system is being incorporated. One field installation procedure which has proved suitable will be described. However, it should be apparent to one skilled in the art that other techniques by which the circuit components of the invention are adjusted to form a function may be utilized. In general, the control system of the invention may be incorporated into a centrifugal compressor operated chiller having unknown surge characteristics. The calibration of the control circuit in the following example assumes electric motor driven PRV with $2^v$–$10^v$ feedback signal, closed to WOV position. When installing the system as a capacity control for a given chiller, the potentiometer 104 and 120 can initially be set to a factory suggested base position of the chiller system. The chilled water temperature control of the chiller is set for 44° F. and the system is then operated with a high load on the chilled water circuit. After the system has reached the chilled water level of 44° F. the installer may determine the chilled water temperature difference and the entering condenser water temperature. Thereafter, referring to suitable data, the installer determines whether the leaving chilled water is between the minimum and maximum allowed. If not, the temperature control knob of the chiller system is then adjusted to bring the leaving chilled water within the limits. The system load is then altered by any suitable means such as turning off air handling fans and the like until the PRV voltage is in the 6–7 volt range. Again, referring to suitable data, it is determined whether the chilled water is between the minimum and maximum amounts allowed and suitable adjustments can be made if it is not.

After the system has stabilized following the foregoing steps in the 6–7 volt PRV range, the chiller system is placed into a "hold" mode. The installer then monitors voltage from the functional turning of the potentiometer 120 a predetermined amount, until the system surges. For example, the potentiometer 120 may be turned $-0.25^v$ every four minutes to have an effect on the functional until surging is encountered. During the latter procedure, the installer maintains the chilled water temperature limits from suitable data. Repeat of creating a system load of 6–7 PRV voltage may be necessary as performed previously. At the surge point, the functional voltage can be determined and the potentiometer 120 adjusted enough additional voltage, i.e., one volt, until the functional reads calculated value. The system is then returned to the automatic mode and the foregoing steps are repeated for PRV voltages in the 3–4 volt range, again determining whether the leaving chilled water temperature is between the minimum and maximum allowed. Potentiometer 104 is then adjusted a predetermined amount until surge occurs such as being turned counterclockwise with the effect on the functional of $-0.50^v$ every four minutes. At the surge point, the functional voltage may be read and an additional voltage, i.e. 1 volt added to adjust potentiometer 104 until the functional reaches calculated value. Thus, the system should be calibrated for all expected operating points.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A method of controlling surge and capacity of an inverter driven centrifugal compressor refrigeration system comprising the steps of:

deriving a signal indicating position of the adjustable inlet vanes of a centrifugal compressor of a refrigeration system, formulating a first output from said signal as a function of vane position, formulating a second output from said signal as a function of speed deviation of the compressor from minimum Mach number based on said vane position, and adjusting said first and second outputs to control the operation of a centrifugal compressor having unknown surging characteristics and avoid surge at all expected operating points.

2. The method according to claim 1 further comprising the steps of:

deriving a third output indicating minimum Mach number, and combining said second and third output.

* * * * *